US009000991B2

(12) United States Patent
Ramberg et al.

(10) Patent No.: US 9,000,991 B2
(45) Date of Patent: Apr. 7, 2015

(54) ANTENNA ASSEMBLIES INCLUDING DIPOLE ELEMENTS AND VIVALDI ELEMENTS

(71) Applicant: Laird Technologies, Inc., Earth City, MO (US)

(72) Inventors: Henrik Ramberg, Manchester, NH (US); Ermin Pasalic, Akersberga (SE)

(73) Assignee: Laird Technologies, Inc., Earth City, MO (US)

( * ) Notice: Subject to any disclaimer, the term of this patent is extended or adjusted under 35 U.S.C. 154(b) by 343 days.

(21) Appl. No.: 13/686,053

(22) Filed: Nov. 27, 2012

(65) Prior Publication Data

US 2014/0145890 A1 May 29, 2014

(51) Int. Cl.

| | |
|---|---|
| ***H01Q 21/00*** | (2006.01) |
| ***H01Q 21/30*** | (2006.01) |
| ***H01Q 9/28*** | (2006.01) |
| ***H01Q 13/08*** | (2006.01) |
| ***H01Q 21/26*** | (2006.01) |

(52) U.S. Cl.
CPC ..... *H01Q 21/30* (2013.01); *H01Q 9/28* (2013.01); *H01Q 13/085* (2013.01); *H01Q 21/26* (2013.01)

(58) Field of Classification Search
USPC ..... 343/725, 727, 797, 770, 793, 794
See application file for complete search history.

(56) References Cited

U.S. PATENT DOCUMENTS

| | | | | |
|---|---|---|---|---|
| 6,028,563 | A | 2/2000 | Higgins | |
| 6,239,750 | B1 | 5/2001 | Snygg | |
| 6,333,720 | B1 | 12/2001 | Göttl et al. | |
| 6,518,931 | B1 | 2/2003 | Sievenpiper | |
| 6,525,696 | B2 | 2/2003 | Powell et al. | |
| 6,933,906 | B2 | 8/2005 | Stolle et al. | |
| 7,079,083 | B2 | 7/2006 | Gottl et al. | |
| 7,132,995 | B2 | 11/2006 | Gottl | |
| 7,283,101 | B2 | 10/2007 | Bisiules et al. | |
| 7,498,995 | B2 | 3/2009 | Kim et al. | |
| 8,072,384 | B2 | 12/2011 | Morrow | |
| 2003/0090431 | A1 | 5/2003 | Gottl | |
| 2004/0113856 | A1* | 6/2004 | Fisher et al. | 343/770 |
| 2004/0252071 | A1 | 12/2004 | Bisiules et al. | |
| 2008/0024382 | A1 | 1/2008 | Uddin et al. | |
| 2008/0211726 | A1 | 9/2008 | Elsallal et al. | |
| 2010/0097286 | A1 | 4/2010 | Morrow et al. | |
| 2010/0141530 | A1 | 6/2010 | McMahon | |

(Continued)

FOREIGN PATENT DOCUMENTS

| | | |
|---|---|---|
| JP | 2006-229975 | 8/2006 |
| WO | WO2012/011796 | 1/2012 |

OTHER PUBLICATIONS

International Search Report and Written Opinion dated Dec. 12, 2013 for PCT Application No. PCT/US2013/054970 filed Aug. 14, 2013 which claims priority to the instant application; 12 pages.

*Primary Examiner* — Dieu H Duong
(74) *Attorney, Agent, or Firm* — Harness, Dickey & Pierce, P.L.C.

(57) ABSTRACT

According to various aspects, exemplary embodiments are disclosed of antenna assemblies having dipole elements and Vivaldi elements. In an exemplary embodiment, an antenna assembly includes a plurality of dipole elements operable in at least a first frequency range and a plurality of Vivaldi elements operable in at least a second frequency range. The plurality of Vivaldi elements may be crossed or arranged relative to each other in a cruciform or a crossed Vivaldi arrangement.

13 Claims, 10 Drawing Sheets

(56) References Cited

U.S. PATENT DOCUMENTS

2010/0171675 A1* 7/2010 Borja et al. ..... 343/798
2011/0175782 A1 7/2011 Choi et al.
2012/0075155 A1 3/2012 Lindmark et al.
2012/0133567 A1 5/2012 Harel et al.

* cited by examiner

ANTENNA ASSEMBLIES INCLUDING DIPOLE ELEMENTS AND VIVALDI ELEMENTS

FIELD

The present disclosure relates to antenna assemblies including dipole elements and Vivaldi elements.

BACKGROUND

This section provides background information related to the present disclosure which is not necessarily prior art.

A common way to provide a dual polarized, dual band antenna assembly using only two radiating elements is to use separate radiating elements for the low band and the high band. For example, first and second dipole elements may be respectively used for the low and high bands.

SUMMARY

This section provides a general summary of the disclosure, and is not a comprehensive disclosure of its full scope or all of its features.

According to various aspects, exemplary embodiments are disclosed of antenna assemblies having dipole elements and Vivaldi elements. In an exemplary embodiment, an antenna assembly generally includes a first radiating element module operable in at least a first frequency range and a second radiating element module operable in at least a second frequency range that is different than the first frequency range. The first radiating element module includes a plurality of dipole elements arranged in a dipole square. The second radiating element module includes a plurality of Vivaldi elements arranged in a crossed Vivaldi arrangement.

In another exemplary embodiment of an antenna assembly, a plurality of dipole dements define a perimeter and are operable in at least a first frequency range. First and second Vivaldi elements are within the perimeter defined by the plurality of dipole elements and operable in at least a second frequency range that is different than the first frequency range. The first and second Vivaldi elements are arranged relative to each other to form a cruciform.

In another exemplary embodiment of an antenna assembly, a plurality of dipole elements are arranged in a dipole square and operable in at least a first frequency range. First and second crossed Vivaldi elements are within a perimeter defined by the dipole square and operable in at least a second frequency range. The first and second Vivaldi elements include one or more electrically nonconductive areas configured for improved cross polarization radiation.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
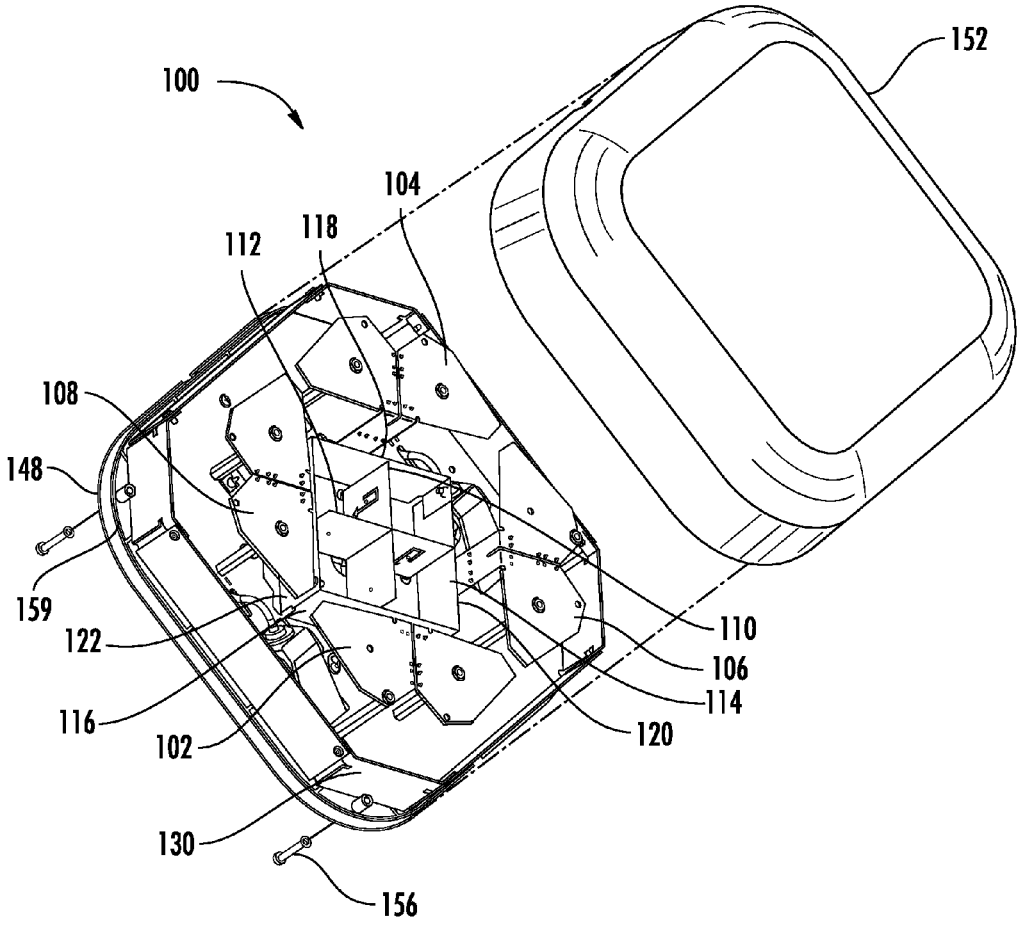
FIG. 1 is a perspective view of an exemplary embodiment of an antenna assembly including four dipole elements arranged in a dipole square for low band operation and two crossed Vivaldi elements for high band operation.
Figure 2:
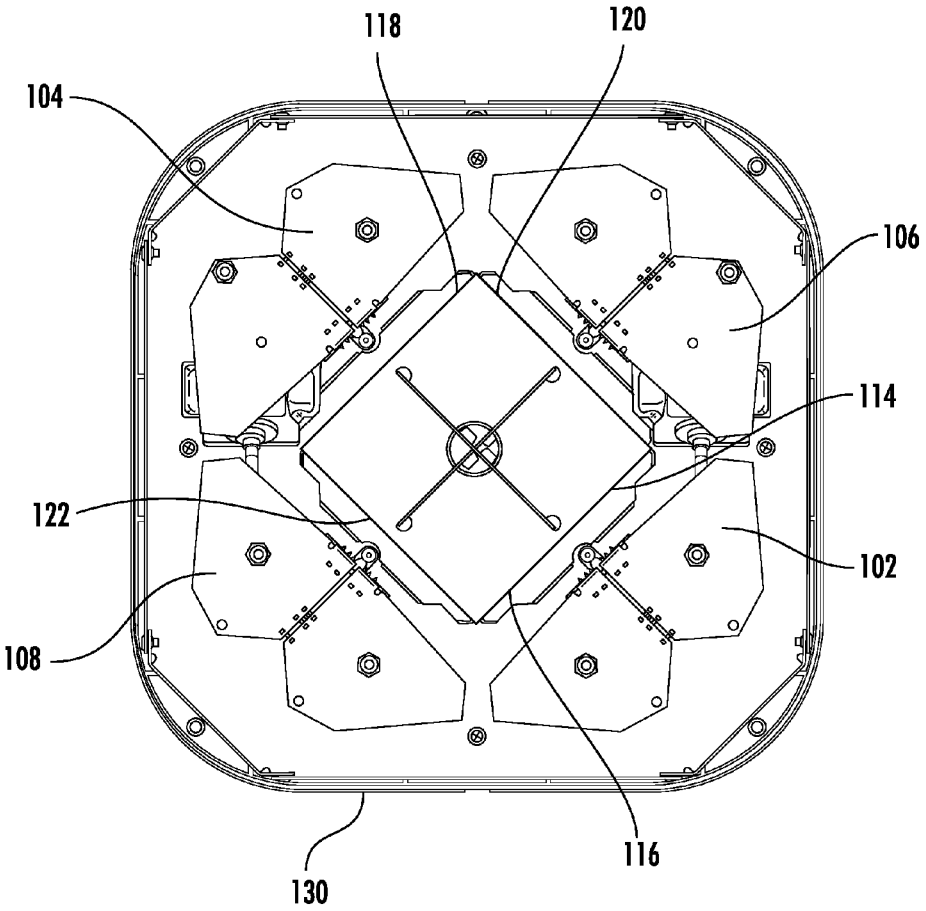
FIG. 2 is a top view of the antenna assembly 100 shown in FIG. 1 without the radome and showing the dipole and Vivaldi elements.
Figure 10A:
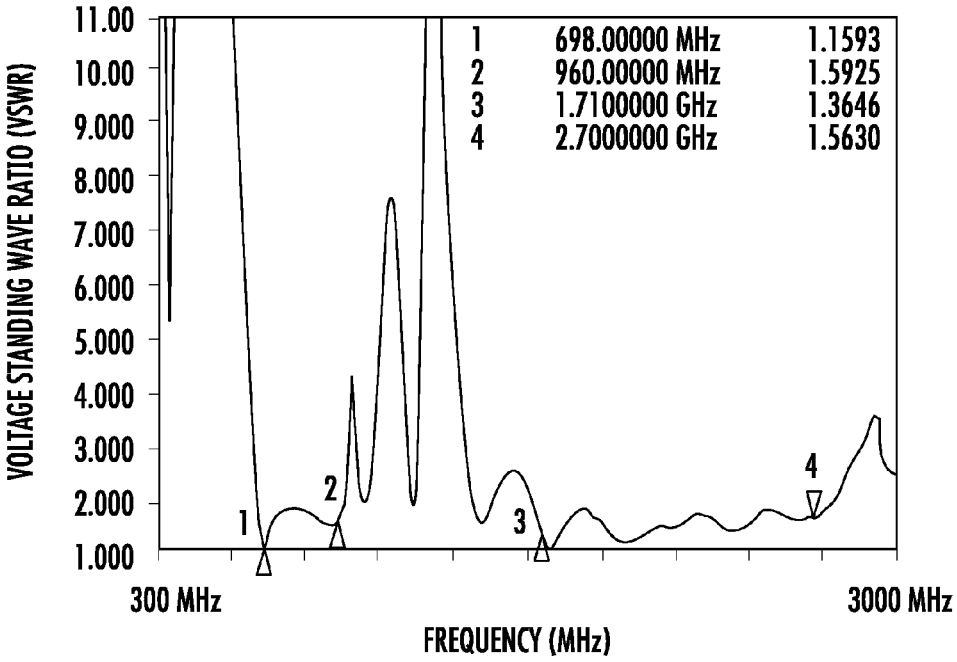
Figure 10B:
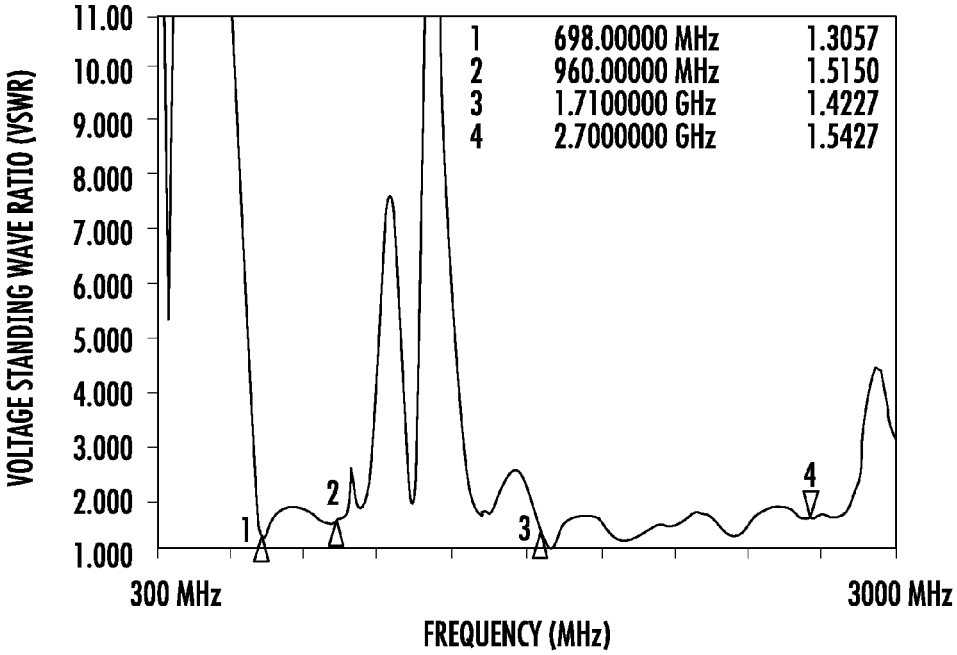
Figure 11:
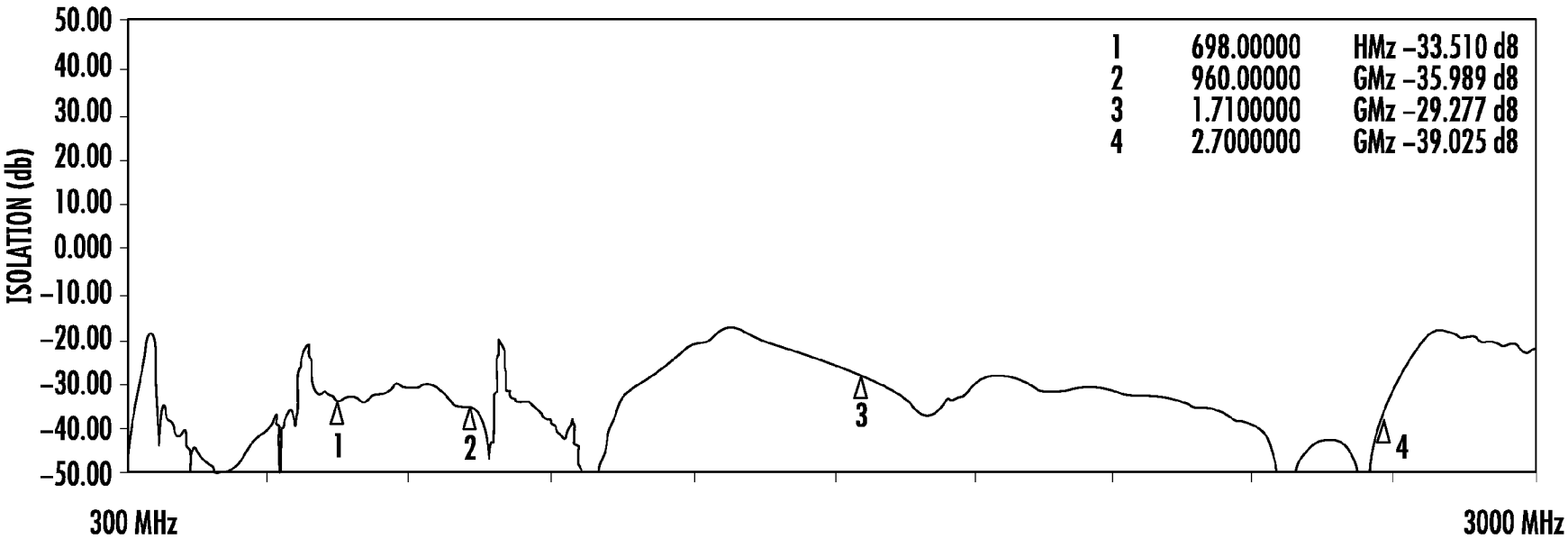

FIGS. 10A and 10B are exemplary line graphs respectively illustrating voltage standing wave ratio (VSWR) versus frequency in gigahertz (GHz) for port1 and port2 of a prototype or FAI (first article of inspection) sample of the antenna assembly shown in FIG. 1; and FIG. 11 is an exemplary line graph respectively illustrating voltage isolation in decibels (dB) versus frequency in gigahertz (GHz) for the isolation between port1 and port2 of the same prototype of the antenna assembly shown in FIG. 1.

Corresponding reference numerals indicate corresponding parts throughout the several views of the drawings.

DETAILED DESCRIPTION

Example embodiments will now be described more fully with reference to the accompanying drawings.

The inventor hereof has recognized that it is difficult to develop or design an antenna element that is dual polarized, dual band, and has acceptable radiation patterns. Typically, an antenna element that provides dual band performance is usually not suitable for a dual polarized application and/or has radiation patterns that are not acceptable. After recognizing the above, the inventor hereof sought to develop antenna assemblies having separate radiating elements for the low and high bands in which the low and high band elements for each polarization are combined with a diplexing feed network.

Accordingly, the inventor has disclosed herein exemplary embodiments of dual polarized multiband antenna assemblies that include low band dipole square elements and high band crossed Vivaldi elements. In one such exemplary embodiment, an antenna assembly includes four dipole elements configured or arranged in a dipole square and operable in a first frequency range or low band (e.g., including frequencies from 698 MHz to 960 MHz, etc.). A pair of Vivaldi elements are positioned within the low band dipole square. The pair of Vivaldi elements are crossed or arranged in a cruciform and operable in a second frequency range or high band (e.g., including frequencies from 1710 MHz to 2700 MHz, etc.). The high and low band elements are combined for each polarization with a diplex feed network. Advantageously, exemplary embodiments may thus provide dual polarized dual band antenna assemblies having separate radiating element modules or assemblies (e.g., a square dipole element module and a crossed Vivaldi element module, etc.) for the low and high bands that are combined for each polarization with a diplexing feed network and that provides acceptable radiation patterns.

In exemplary embodiments, the Vivaldi elements may include cutouts on the vertical side for improved cross polarization radiation. The Vivaldi elements (with the cutout) together with the low band dipole square elements provide a more broadband antenna with good dual polarization and good radiation pattern performance.

With reference now to the figures, FIG. 1 illustrates an exemplary embodiment of an antenna assembly 100 embodying one or more aspects of the present disclosure. As shown in FIG. 1, the antenna assembly 100 includes a first radiating element module operable in at least a first frequency range or low band, and a second radiating element module operable in at least a second frequency range or high band. The first radiating element module includes first, second, third, and fourth dipole elements 102, 104, 106, 108 arranged in a dipole square. The second radiating element module includes first and second Vivaldi elements 110, 112 arranged in a crossed Vivaldi arrangement.

The first radiating element module and its dipole elements 102, 104, 106, 108 are operable for transmitting and receiving electromagnetic radiation or signals in the first frequency range or low band (e.g., including frequencies from 698 MHz to 960 MHz, etc.) with two linear orthogonal polarizations (e.g., dual linear slant +/−45 degree or horizontal and vertical polarizations). The second radiating element module and its crossed Vivaldi elements 110, 112 are operable for transmitting and receiving electromagnetic radiation or signals in the second frequency range or high band (e.g., including frequencies from 1710 MHz to 2700 MHz, etc.) also with two linear orthogonal polarizations (e.g., dual linear slant +/−45 degree or horizontal and vertical polarizations). In an exemplary embodiment of the antenna assembly 100, the radiating elements are configured to radiate with dual linear slant +/−45 degree orthogonal polarizations. In another example embodiment of the antenna assembly 100, the radiating elements are configured to radiate with horizontal and vertical orthogonal polarizations.

Figure 6:
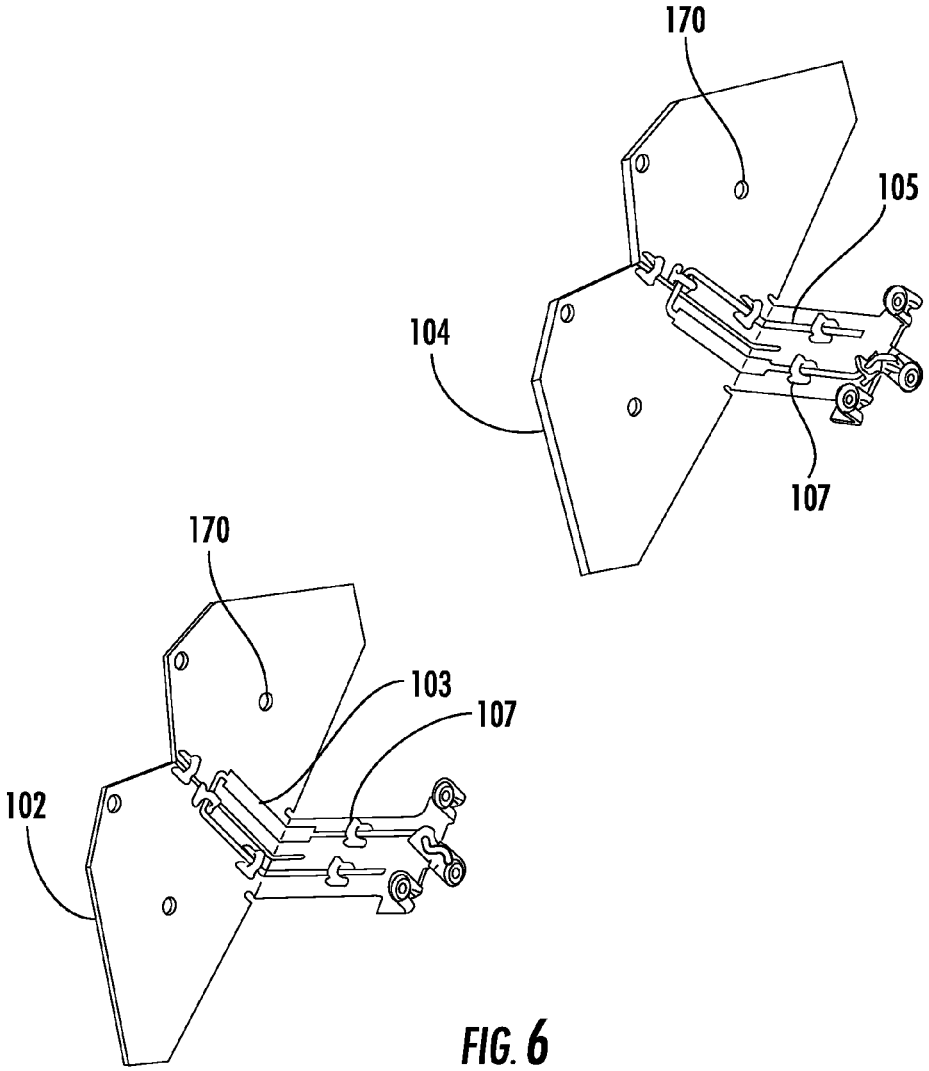
FIG. 6 is a perspective view of a pair of dipole elements shown in FIG. 5.

The four dipole elements 102, 104, 106, 108 are positioned at right angles relative to one another. The four dipole elements 102, 104, 106, 108 are arranged in a dipole square with the dipole elements 102, 104, 106, 108 generally oriented in an orientation or aligned in an alignment of +/−45 degrees with respect to a vertical. Dipole elements 102 and 104 are also shown in FIG. 6, along with feed probes 103, 105 and feed line spacers 107. The feed probes 103, 105 may pass through openings (e.g., holes, slots, etc.) of the second or outer reflector 130 and through openings (e.g., holes, slots, etc.) of the PCB 113 for connection (e.g., solder, etc.) to a feed network. The feed line spacers 107 may be attached by using adhesive, e.g., using Loctite adhesive, etc.

Figure 3:
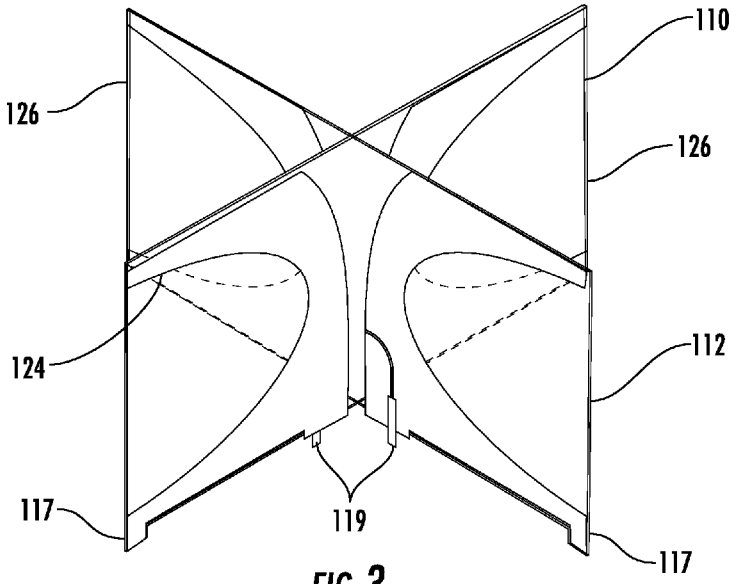
FIG. 3 is a perspective view of the crossed Vivaldi elements shown in FIG. 1.
Figure 7:
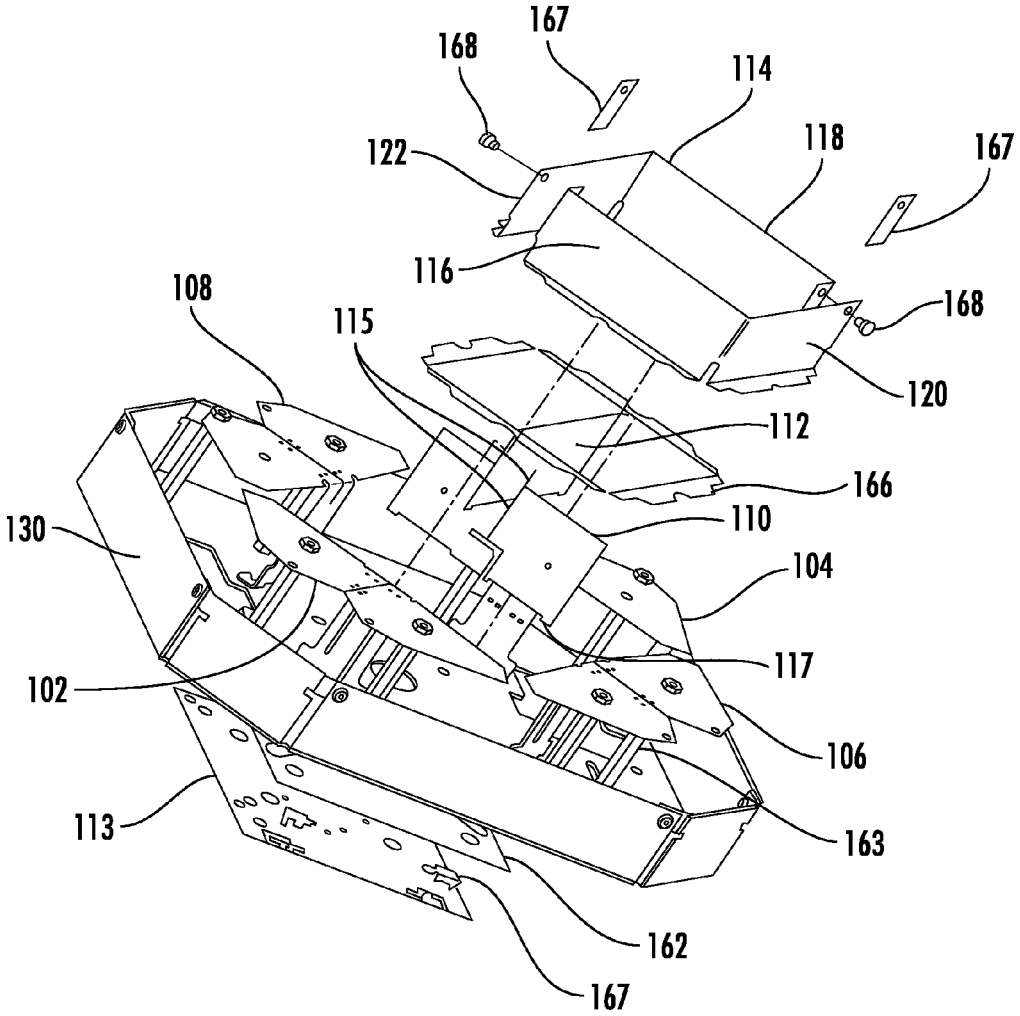
FIG. 7 is an exploded perspective view showing the Vivaldi elements ready to be assembled together and the isolator/reflector walls ready to be assembled together and disposed between the dipole and Vivaldi elements according to an exemplary embodiment.

The crossed Vivaldi elements 110, 112 are arranged or positioned internally or within a perimeter or footprint defined by the dipole square formed by the dipole elements 102, 104, 106, 108. The pair of Vivaldi elements 110, 112 are crossed and oriented generally perpendicularly or orthogonally to each other, such that the Vivaldi elements 110, 112 are configured in a cruciform (FIG. 3). As shown in FIG. 7, the Vivaldi elements 110, 112 includes slots or notches 115 for slidably receiving a portion of the other Vivaldi element 110, 112 therein. The Vivaldi elements 110, 112 also include grounding portions or tabs 117 configured to be positioned through openings (e.g., holes, slots, etc.) in the reflector 130 and then electrically connected (e.g., soldered, etc.) and grounded to corresponding grounding portions of the PCB 113. In addition, the Vivaldi elements 110, 112 also include probes 119 printed on their respective PCBs. The probes 119 are configured to be positioned through openings (e.g., holes, slots, etc.) in the reflector 130 and openings (e.g., holes, slots, etc.) in the PCB 113 to be electrically connected (e.g., soldered, etc.) to a feed network. At least a portion (e.g., a backside, etc.) of each probe 119 is grounded to the PCB 113.

In the illustrated embodiment of FIG. 1, the Vivaldi elements 110, 112 are aligned parallel or perpendicularly to the corresponding dipole elements 102, 104, 106, 108. As shown in FIG. 1, the Vivaldi element 110 is perpendicular to the dipole elements 102, 104 and parallel to the dipole elements 106, 108. The Vivaldi element 112 is parallel to the dipole elements 102, 104 and perpendicular to the dipole elements 106, 108.

Each pair of dipole elements that are directly across from each other are fed in phase (e.g., via a diplexing feed network, etc.) and radiate with the same linear polarization. Accordingly, the dipole elements 102, 104 are fed in phase with each other and may radiate with either horizontal or vertical polarization, or they may radiate with a slant +45 degree or −45 degree linear polarization. The other dipole elements 106, 108 are also fed in phase with each other but may radiate with the other linear polarization that is orthogonal to the polarization in which the dipole elements 102, 104 radiate. For example, the dipole elements 102, 104 may radiate with horizontal polarization, while the other dipole elements 106, 108 radiate with vertical polarization. In this example, the dipole elements 102, 104 provide low band operation with horizontal polarization, while the dipole elements 106, 108 provide low band operation with vertical polarization. Conversely, the dipole elements 102, 104 may provide low band operation with vertical polarization, while the dipole elements 106, 108 may provide low band operation with horizontal polarization. In either case, the first radiating element module and its dipole elements 102, 104, 106, 108 are operable for transmitting and receiving electromagnetic radiation or signals in the first frequency range with horizontal and vertical polarizations.

By way of further example, the dipole elements 102, 104 may radiate with a +45 degree linear polarization. The other dipole elements 106, 108 may radiate with a −45 degree linear polarization, which is orthogonal to the +45 degree polarization in which the dipole elements 102, 104 radiate. In this example, the dipole elements 102, 104 provide low band operation with the +45 degree linear polarization, while the dipole elements 106, 108 provide low band operation with the −45 degree linear polarization. Conversely, the dipole elements 102, 104 may provide low band operation with the −45 degree linear polarization, while the dipole elements 106, 108 may provide low band operation with the +45 degree linear polarization. In either case, the first radiating element module and its dipole elements 102, 104, 106, 108 are operable for transmitting and receiving electromagnetic radiation or signals in the first frequency range with dual slant +/−45 degree linear orthogonal polarizations.

Figure 4:
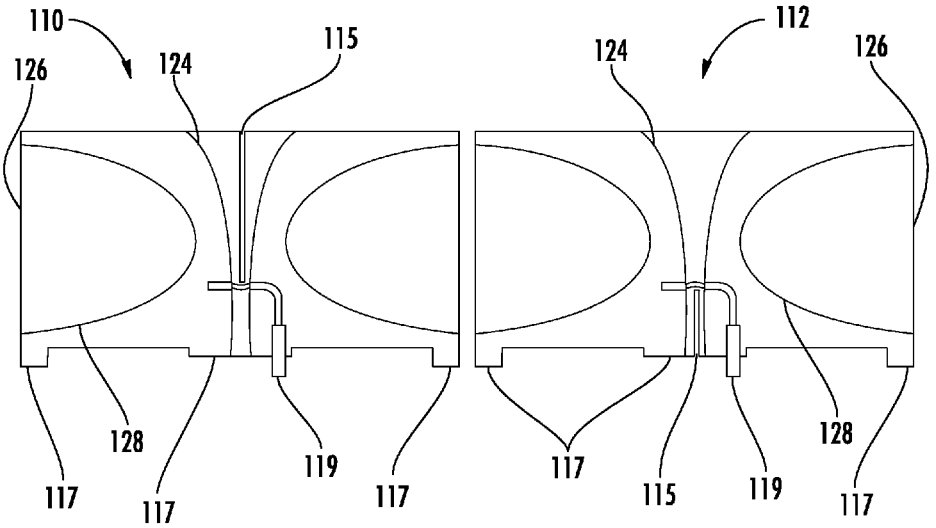
FIG. 4 is a view of the Vivaldi elements shown in FIG. 3 laying side-by-side before being assembled together, and illustrating the vertical cutouts for improved cross polarization according to an exemplary embodiment.

With reference to FIGS. 3 and 4, the crossed Vivaldi elements 110, 112 have orthogonal polarizations relative to each other (e.g., dual linear slant +/−45 degree orthogonal polarizations or horizontal and vertical polarizations). The crossed Vivaldi elements 110, 112 include radiating elements 124 on one side of their respective substrates 126. The radiating elements 124 are configured such that there are electrically nonconductive areas 128 (e.g., cut outs, slots, etc.), which help significantly improve cross polarization according to an exemplary embodiment. The Vivaldi elements 110, 112 (with the cutouts 128) together with the low band dipole square elements 102, 104, 106, 108 make it possible to achieve a more broadband antenna with good dual polarized and radiation pattern performance.

As shown in FIG. 3, the nonconductive areas or cut outs 128 comprise areas on the substrates 126 without electrically-conductive material (e.g., copper traces, copper metallization, etc.) thereon. By way of example, the nonconductive areas or cut outs 128 may comprise areas on the substrates 126 at which the electrically-conductive material forming the radiating elements 124 has been etched, cut, or otherwise removed. In this illustrated embodiment, the nonconductive areas or cut outs 128 have a generally semi oval or half oval shape, and the radiating elements 124 have a generally crescent shape. Alternative embodiments may include nonconductive areas, cut outs, and/or radiating elements that are shaped differently.

The Vivaldi elements 110, 112 may radiate with linear orthogonal polarizations relative to each other. For example, the Vivaldi element 110 may radiate with a horizontal polarization, while the other Vivaldi element 112 may radiate with a vertical polarization. Conversely, the Vivaldi element 110 may instead radiate with a vertical polarization, while the other Vivaldi element 112 may radiate with a horizontal polarization. In either case, the second radiating element module and its crossed Vivaldi elements 110, 112 are operable for transmitting and receiving electromagnetic radiation or signals in the second frequency range with horizontal and vertical polarizations.

By way of further example, the Vivaldi element 110 may radiate with a +45 degree linear polarization, while the other Vivaldi element 112 may radiate with a −45 degree linear polarization. Conversely, the Vivaldi element 110 may instead radiate with a −45 degree linear polarization, while the other Vivaldi element 112 may radiate with a +45 degree linear polarization. In either case, the second radiating element module and its crossed Vivaldi elements 110, 112 are operable for transmitting and receiving electromagnetic radiation or signals in the second frequency range with dual slant +/−45 degree linear orthogonal polarizations.

The antenna assembly 100 also includes a diplex feed network. The diplex feed network is operable for combining the low and high band elements for each polarization. For the illustrated antenna assembly 100, the diplex feed network comprises one diplex filter per port, and the diplexer is made of microstripe lines on a PCB for this example. This is but one example that may be used with the antenna assembly 100, as other types of feeds may be used in other embodiments. Alternative feed networks may also be used, such as other microstrip transmission lines, serial or corporate feeding networks, etc.

With continued reference to FIG. 1, the high band crossed Vivaldi elements 110, 112 are isolated from the low band dipole elements 102, 104, 106, 108 by an isolator or reflector 114 in which the cross Vivaldi elements 110, 112 are positioned. The isolator or reflector 114 also helps to shape the beam, or is a beam shaper for the Vivaldi elements 110, 112. In this example, the isolator or reflector 114 includes four walls 116, 118, 120, 122 defining a generally rectangular (e.g., square, etc.) shape that corresponds to the shape of the dipole square defined by the dipole elements 102, 104, 106, 108. Each wall 116, 118, 120, 122 is disposed along or adjacent to a corresponding one of the dipole elements 102, 104, 106, 108 so as to be positioned generally between the corresponding dipole element and the crossed Vivaldi elements 110, 112. Having the dipole elements and crossed Vivaldi elements on opposite exterior and interior sides of the isolator/reflector walls thus allows the walls to isolate the dipole elements from the crossed Vivaldi elements and vice versa. In this example, the isolator or reflector 114 is generally square so as to match the shape of the dipole square. Alternative embodiments may include a dipole element module or assembly and an isolator or reflector that are shaped differently than square, e.g., non-square rectangular shape, etc.

The antenna assembly 100 further includes an outer reflector 130. In this example, the reflector 130 includes eight sidewalls defining a generally octagonal shape, which may help the antenna assembly 100 fit within a smaller, more aesthetic radome 152. The sidewalls extend generally perpendicular to the bottom wall of the reflector 130. In operation, the reflector 130 helps to improve the front-to-back (f/b) radiation by lowering the energy that goes back. The reflector 130 helps to reflect and direct signals from the radiating elements of the antenna assembly 100 in an outward direction. For example, the reflector 130 helps to reflect and direct signals downward when the antenna assembly 100 is mounted to a ceiling for downward looking radiation. Or, for example, the reflector 130 helps to reflect and direct signals upward when the antenna assembly 100 is placed on a surface facing upwards for upward looking radiation. Alternative embodiments may include an outer reflector that is shaped differently than octagonal, such as square, rectangular, etc. For example, another exemplary embodiment of the antenna assembly 100 may include a square reflector, which may help improve performance.

Figure 5:
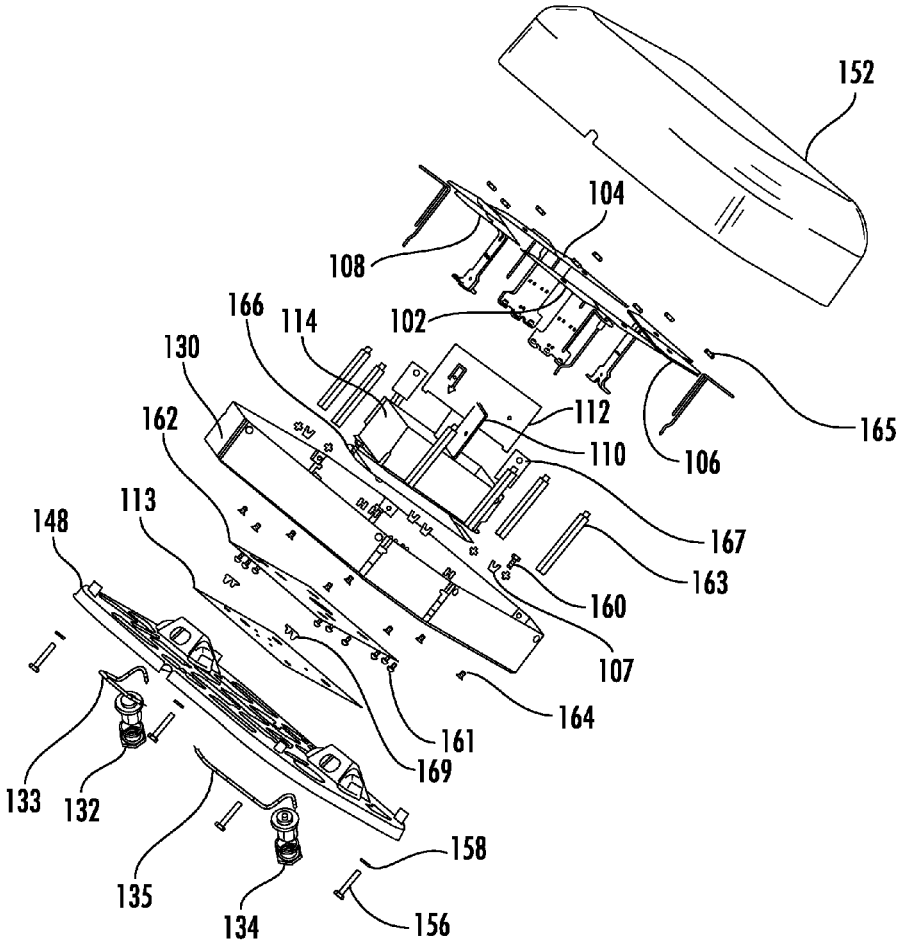
FIG. 5 is an exploded perspective view of the antenna assembly shown in FIG. 1 and illustrating various exemplary components that may be used while assembling the antenna assembly according to an exemplary embodiment.
Figure 8:
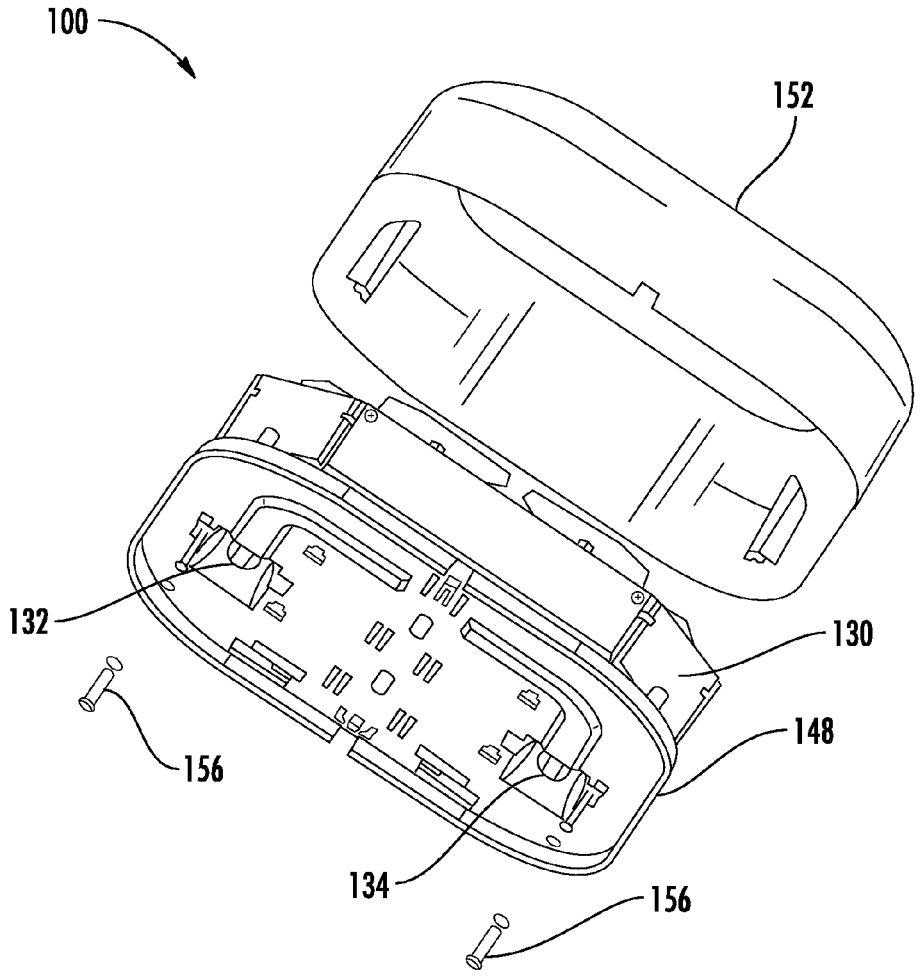
FIG. 8 is an exploded perspective view showing the radome aligned for positioning over the dipole and Vivaldi elements and for attachment to the base of the antenna assembly according to an exemplary embodiment.

As shown in FIGS. 5 and 8, the antenna assembly 100 includes first and second ports 132, 134. The ports 132, 134 include corresponding electrical connectors (FIG. 5) configured for a pluggable connection to another device for communicating signals between the antenna assembly 100 and the another device. This exemplary configuration includes the use of N-connectors. Other exemplary types of electrical connections may also be used including coaxial cable connectors, ISO standard electrical connectors, Fakra connectors, SMA connectors, an I-PEX connector, a MMCX connector, etc. By way of example, the antenna assembly 100 may be used as a two-port indoor directional antenna. By way of further example, FIG. 5 illustrates the antenna assembly 100 having exemplary coaxial cables 133, 135 that are connectable to the connectors at the respective ports 132, 134. Other embodiments may include different means for communicating signals to/from the antenna assembly 100.

As explained above, the dipole elements 102, 104 may radiate with a polarization orthogonal to the polarization of the other dipole elements 106, 108, e.g., horizontal and vertical polarizations or dual slant +/−45 degree linear orthogonal polarizations. Also, the Vivaldi elements 110, 112 may also radiate with linear orthogonal polarizations relative to each other, e.g., horizontal and vertical polarizations or dual slant +/−45 degree linear orthogonal polarizations. The antenna assembly 100 may thus be operable for producing linear polarized coverage for one of the two ports 132, 134 in the first and second frequency ranges and for producing linear polarized coverage for the other port 132 or 134 in the first and second frequency ranges, such that the polarizations associated with the ports 132, 134 are orthogonal to each other. Accordingly, this exemplary embodiment of an antenna assembly 100 therefore has a dual-polarized design (e.g., dual linear +/−45 degree antenna design), which may also provide, e.g., via the reflector/isolator 114 reduced coupling of the radiating antenna elements. Having radiating antenna elements with a polarization that is orthogonal to the polarization of other radiating elements may also enhance MIMO (multiple input, multiple output) performance through polarization diversity. Alternative embodiments may include more or less than two ports.

The illustrated antenna assembly 100 further includes a chassis or base 148 (broadly, a support member) and a radome or housing 152 removably mounted to the chassis 148. The radome 152 may help protect the various antenna components enclosed within the internal space defined by the radome 152 and chassis 148. The radome 152 may also provide an aesthetically pleasing appearance to the antenna assembly 100. Other embodiments may include radomes and covers configured (e.g., shaped, sized, constructed, etc.) differently than disclosed herein within the scope of the present disclosure.

Figure 9:
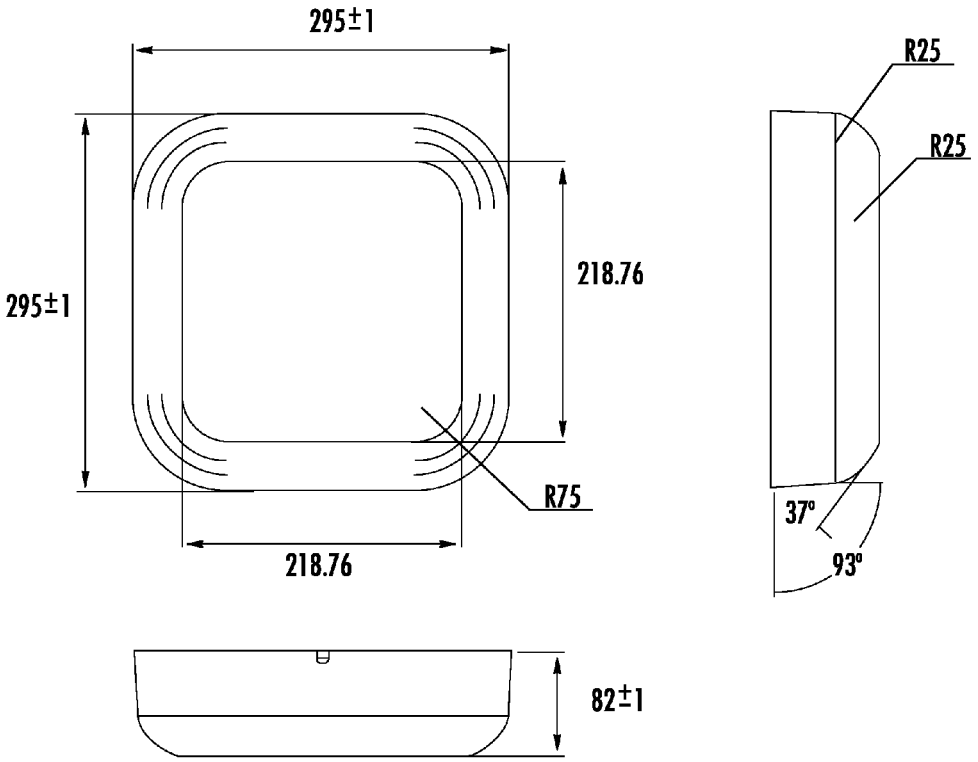
FIG. 9 are front and side views of the radome shown in FIG. 1 with exemplary dimensions in millimeters provided for purpose of illustration only according to an exemplary embodiment.

The radome 152 may be attached to the chassis 148 by mechanical fasteners (e.g., screws 156 and O-rings 158 (FIG. 5), other fastening devices, etc.). A sealing member 159 (e.g., elastomeric sealing member, 3M sealant, etc.) may be disposed about the perimeter of the chassis 148 as shown in FIG. 1, for sealing an interface between the chassis 148 and radome 152. Alternatively, the radome 152 may be snap fit to the chassis 148 or via other suitable fastening methods/means within the scope of the present disclosure. In addition, FIG. 9 provides exemplary dimensions for a radome (e.g., radome 152, etc.) for purpose of illustration only according to an exemplary embodiment. As shown in FIG. 9, the radome 152 may have a height or thickness of 82 millimeters (mm) and a length and width of 295 millimeters. Alternative embodiments may include a radome with a different configuration, such as a different shape and/or different size.

A wide range of suitable materials may be used for the various components of the antenna assembly 100. By way of example only, an exemplary embodiment includes aluminum dipole elements 102, 104, 106, 108 and aluminum reflectors 114 and 130. The substrates 126 of the Vivaldi elements 110, 112 may be FR4, which is a composite material of woven fiberglass cloth with an epoxy resin binder that is flame resistant. The Vivaldi radiating elements 124 may be copper (e.g., copper traces on a printed circuit board, copper metallization, etc.). A wide range of materials, configurations (e.g., sizes, shapes, constructions, etc.), and manufacturing processes may also be used for the chassis 148 (which may also or instead be referred to as a ground plane) and radome 152. In various exemplary embodiments, the radome 152 is injection molded plastic or vacuum formed out of thermoplastic, and the chassis or ground plane 148 is electrically conductive (e.g., aluminum, etc.) for electrically grounding the radiating antenna elements. Alternative embodiments may include other one or more components formed from other electrically-conductive materials (e.g., other metals besides aluminum and copper, etc.) and/or other dielectric materials for the Vivaldi substrate besides FR4. In addition, other exemplary embodiments may be configured to be operable in more than two bands and/or different frequency bands.

FIGS. 5 through 8 illustrate various exemplary components that may be used while assembling the antenna assembly 100 according to an exemplary embodiment. These exemplary components and the accompanying assembly process are provided for purpose of illustration only as alternative embodiments may include different components (e.g., different fasteners and/or seals, etc.) and/or be assembled by a different process.

In addition to the components mentioned above, FIG. 5 further illustrates the following additional components that may be used. For example, mechanical fasteners (e.g., screws 160, etc.) may be used to attach the reflector 130 to the base 148. Mechanical fasteners (e.g., screws 161, etc.) may be used to mount the dipole elements 102, 104, 106, 108 to the reflector 130. Adhesive 162 may be positioned between the PCB 113 and reflector 130, to thereby adhesively attach the PCB 113 to the bottom of the reflector 130. FIG. 5 further illustrates standoffs 163 that may be fastened between the dipole elements 102, 104, 106, 108 and the reflector 130 via mechanical fasteners, e.g., threaded pem studs 164 and nuts 165, etc.

As shown in FIG. 7, adhesive 166 (e.g., four adhesive tapes, pads, strips, pieces, etc.) may be used along the bottom edge portions of the reflector walls 116, 118, 120, 122 to attach the walls to the reflector 130. Adhesive 167 (e.g., two adhesive pads, strips, pieces, etc.) and mechanical fasteners (e.g., rivets 168, etc.) may be along the top edge portions for holding the reflector walls 118 and 120 to each other and for holding the reflector walls 116, 122 to each other. In this example, the walls 118, 120 are formed from a single piece, and walls 116, 122 are formed from a second single piece. Also in this example, the isolator/reflector 114 does not include any bottom wall as the walls 116, 118, 120, 122 may be mounted or attached to the reflector 130 via the adhesive 166 and mechanical fasteners 160. Cable connector grounds 169 are also shown in FIG. 5.

A description will now be provided of an exemplary method by which the exemplary embodiment of the antenna assembly 100 may be assembled together. This method and the various steps thereof are provided for purpose of illustration only as other embodiments may include a different process to assemble an antenna assembly, including a different order of the steps, one or more different steps, one or more additional steps, etc.

With reference to FIGS. 5 and 7, pem studs 164 are first pressed into openings or holes in the bottom wall of the octagonal reflector 130 from the bottom. Adhesive (e.g., Loctite 380 adhesive, etc.) is applied to the threaded holes at the bottom of the standoffs 163 before the standoffs 163 are screwed onto the threaded portions of the pem studs 164 extending upward from the bottom wall of the reflector 130.

The feed probes 103, 105 (FIG. 6) are mounted to the corresponding dipoles via the feed line spacers 107. The spacers 107 are slotted to the probes 103, 105 through the small cut-outs of the spacers 107. An open probe end may be used in other embodiments. The feed line spacers 107 are attached by using adhesive. For example, Loctite 403 adhesive may be applied to the portions of the feed line spacers 107 that contact the probes 103, 105 and the portions of the feed line spacers 107 that contact the dipole areas.

The dipole elements 102, 104, 106, 108 are mounted to the reflector 130 using mechanical fasteners 161 (e.g., using 12 MRT-TTscrews, etc.), which may be tightened (e.g., 75 Newton-centimeter (N-cm), etc.) with an appropriate torque wrench tooling. At this stage, the top threaded portions of the standoffs 163 extend through holes 170 (FIG. 6) in the dipole areas. Hex nuts 165 are then screwed (e.g., 8 N-cm, etc.) onto those threaded portions of the standoffs 163 that extend through the holes 170. Adhesive (e.g., Loctite 380 adhesive, etc.) is applied to the hex nuts 165 to further secure the assembly components. Accordingly, the dipole elements 102, 104, 106, 108 are now mounted to the reflector 130 at the conclusion of the above method steps.

The reflector 114 may next be assembled by first applying adhesive 167 to the outside of the small flanges on the reflector walls 116, 118 as shown in FIGS. 5 and 7. The walls 116 and 122 are then assembled to each other using a rivet 168 and an appropriate rivet tool. Likewise, the walls 118 and 120 are assembled to each other using a rivet 168 and an appropriate rivet tool. Adhesive 166 (e.g., four adhesive tapes, pads, strips, pieces, etc.) is applied to bottom flanges of the reflector walls 116, 118, 120, 122 to attach the walls to the reflector 130. In this example, the bottom flanges of the reflector walls 116, 118, 120, 122 are shaped similarly to the shape to the corresponding adhesive piece applied thereto. Preferably, a fixture is used in order to help ensure an exact or more accurate positioning of the walls 116, 118, 120, 122 relative to the reflector 130.

Two cable connector grounds 169 are mounted from underneath the PCB 113 and solder all around. Adhesive 162 is mounted and attached to the PCB 113, and used to mount the PCB 113 to the reflector 130. A guiding fixture may be used as necessary during this operation of mounting the PCB 113 to the reflector 130.

The PCBs of the Vivaldi elements 110, 112 are positioned relative to the reflector 130 such that the Vivaldi grounding portions or tabs 117 are positioned through openings (e.g., holes, slots, etc.) in the reflector 130. Then, the grounding portions 117 are electrically connected (e.g., soldered, etc.) to corresponding grounding portions of the PCB 113, to thereby ground the Vivaldi elements 110, 112 to the PCB 113. In addition, the probes 119 of the Vivaldi elements 110, 112 are positioned through openings (e.g., holes, slots, etc.) in the reflector 130 and also through openings (e.g., holes, slots, etc.) in the PCB 113. Then, the probes 119 are electrically connected (e.g., soldered, etc.) to a feed network. By way of example, the Vivaldi PCBs may be pushed (e.g., via the non-copper side, etc.) against the reflector 130 in order to ensure correct positioning. By way of further example, this exemplary embodiment includes a total of eight grounding tabs 117.

Coaxial cables 133, 135 are soldered to the connectors 132, 134, for example, by using a resistance soldering tool after removing the O-rings from the connectors to prevent melting during the soldering process. The coaxial cables 133, 135 are preferably formed in a specially designed fixture in order to match the shape of the cavities in the base 148. The braids of the coaxial cables 133, 135 are soldered to the cable connector grounds 169. The center conductors of the coaxial cables 133, 135 are soldered to the PCB 113. The removed O-rings are inserted or added back onto the connectors 132, 134. The connectors 132, 134 are pulled through holes of the base 148. Screws 160 may then be tightened (e.g., with torque of 50 N-cm, etc.) to thereby attach the reflector 130 to the base 148. A washer and nut may be assembled onto the connectors 132, 134 and tightened (e.g., to 150 N-cm with torque wrench tool, etc.). The connectors 132, 134 face downward when the antenna assembly 100 is in the upright position.

Sealant (e.g., 3M sealant 5200 FC, etc.) is applied circumferentially to an inner surface of the radome 152 along the entire perimeter of the radome 152, e.g., five millimeters from the bottom of the radome 152, etc. Sealant may also be applied along an perimeter edge of the base 148. The radome 152 is mounted to the base 148 using screws 156 and O-rings 158, which screws 156 may be tightened with torque of 75 N-cm, etc. The sealant is allowed to cure horizontally with the connectors facing downward. One or more labels may be applied to the bottom of the base 148.

FIGS. 10A, 10B, and 11 provide analysis results measured for a prototype or FAI (first article of inspection) sample of the antenna assembly 100 shown in FIG. 1. These analysis results are provided only for purposes of illustration and not for purposes of limitation.

More specifically, FIGS. 10A and 10B are exemplary line graphs respectively illustrating voltage standing wave ratio (VSWR) versus frequency in gigahertz (GHz) for port1 and port 2 of a prototype or FAI (first article of inspection) sample of the antenna assembly 100. FIG. 11 is an exemplary line graph respectively illustrating isolation in decibels (dB) versus frequency in gigahertz (GHz) for the isolation between port1 and port2 of the same prototype of the antenna assembly 100.

Generally, FIGS. 10A and 10B show that the antenna assembly 100 had a good VSWR of less than 2 for frequencies within a first frequency range or low band including frequencies from 698 MHz to 960 MHz and within a second frequency range or high band including frequencies from 1710 MHz to 2700 MHz. As shown in FIG. 10A, the VSWR for port1 was 1.1593 at 698 MHz, 1.5925 at 960 MHz, 1.3646 at 1710 MHz, and 1.5630 at 2700 MHz. As shown in FIG. 10B, the VSWR for port2 was 1.3057 at 698 MHz, 1.5150 at 960 MHz, 1.4227 at 1710 MHz, and 1.5427 at 2700 MHz.

FIG. 11 generally shows that the antenna assembly 100 has good isolation between port1 and port2 for the low band including frequencies from 698 MHz to 960 MHz and the high band including frequencies from 1710 MHz to 2700 MHz. Specifically, the isolation between port1 and port2 was −33.510 dB at 698 MHz, −35.989 dB at 960 MHz, −29.277 dB at 1710 MHz, and −39.025 dB at 2700 MHz.

Azimuth plane radiation patterns were also measured for the first and second ports of the same prototype of the antenna assembly 100 at various frequencies. The results are summarized in the table below for the first and second ports respectively referred to as Port1 and Port2 in the table.

| Port1 | | | | |
|---|---|---|---|---|
| Frequency | 3D | | Azimuth | E total f/ |
| (MHz) | Efficiency | Max Gain | Beamwidth | b ratio dB |
| 698 | 85% | 8.24 | 71.24 | −22.5 |
| 800 | 81% | 8.59 | 67.27 | −25.6 |
| 900 | 81% | 9.28 | 59.41 | −27.9 |
| 960 | 84% | 9.76 | 56.74 | −24.1 |
| 1710 | 77% | 6.31 | 80.16 | −23.5 |
| 1800 | 78% | 6.9 | 66.09 | −17.0 |
| 1850 | 74% | 6.66 | 67.64 | −16.4 |
| 1880 | 75% | 7.03 | 66.51 | −15.9 |
| 1900 | 77% | 7.45 | 61.71 | −14.8 |
| 1920 | 83% | 7.43 | 64.16 | −15.7 |
| 1990 | 83% | 8.4 | 56.75 | −18.4 |
| 2000 | 85% | 8.73 | 55 | −18.6 |
| 2100 | 85% | 8.92 | 54.12 | −19.3 |
| 2170 | 81% | 8.43 | 71.35 | −19.6 |
| 2200 | 79% | 8.81 | 72.78 | −18.8 |
| 2300 | 82% | 9.02 | 64.21 | −23.4 |
| 2400 | 85% | 9.66 | 53.03 | −24.7 |
| 2500 | 77% | 9.57 | 49.69 | −23.9 |
| 2600 | 80% | 9.37 | 59.25 | −26.2 |
| 2700 | 67% | 8.91 | 48.18 | −23.9 |

| Port2 | | | | |
|---|---|---|---|---|
| Frequency | 3D | | Azimuth | E total f/b ratio |
| (MHz) | Efficiency | Max Gain | Beamwidth | dB |
| 698 | 85% | 8.19 | 71.12 | −20.5 |
| 800 | 82% | 8.59 | 67.24 | −22.2 |
| 900 | 82% | 9.27 | 59.5 | −29.1 |
| 960 | 86% | 9.84 | 57.54 | −22.8 |
| 1710 | 78% | 6.29 | 78.32 | −22.1 |
| 1800 | 83% | 7.08 | 63.44 | −15.5 |
| 1850 | 77% | 6.68 | 66.61 | −15.5 |
| 1880 | 75% | 7.12 | 61.54 | −13.6 |

-continued

| Port2 | | | | |
|---|---|---|---|---|
| Frequency | 3D | | Azimuth | E total f/b ratio |
| (MHz) | Efficiency | Max Gain | Beamwidth | dB |
| 1900 | 78% | 7.19 | 64.57 | −14.0 |
| 1920 | 85% | 7.57 | 63.27 | −15.5 |
| 1990 | 83% | 8.37 | 56.74 | −17.4 |
| 2000 | 84% | 8.65 | 55.21 | −17.8 |
| 2100 | 84% | 8.86 | 53.12 | −19.1 |
| 2170 | 80% | 8.48 | 73.07 | −20.0 |
| 2200 | 76% | 8.74 | 73.2 | −19.0 |
| 2300 | 80% | 9.15 | 60.3 | −24.8 |
| 2400 | 84% | 9.66 | 51.52 | −31.3 |
| 2500 | 76% | 9.44 | 49.69 | −28.1 |
| 2600 | 79% | 9.82 | 47.97 | −21.7 |
| 2700 | 69% | 9.05 | 49.63 | −20.2 |

The radiation pattern test results show that the antenna assembly 100 has a bandwidth spread of 56° to 71° for the low band from 698 MHz to 960 MHz and 48° to 81° for the high band from 1710 MHz to 2700 MHz. The gain (+/−0.5 decibels (dB)) was 8.2 dB to 9.7 dB for the low band and 5.7 dB to 9.5 dB for the high band. The front to back ratio was greater than 16.9 dB for the low band, and only the frequency 1880 MHz had a front to back ratio less than 15 dB for the high band. Generally, this testing shows that the antenna assembly 100 has good bandwidth spread, good gain, and good directivity with a high front to back ratio for the low band from 698 MHz to 960 MHz and the high band from 1710 MHz to 2700 MHz.

As noted above, these analysis results are provided only for purposes of illustration and not for purposes of limitation. An FAI sample or prototype of the antenna assembly 100 or other antenna assembly disclosed herein may have other values for the VSWR for port1 and port2 and/or other values for the isolation between port1 and port2.

By way of further example only, a second prototype or FAI sample of the antenna assembly 100 was created and tested. The second sample also had a good VSWR of less than 2, good isolation, good bandwidth spread, good gain, and good directivity with a high front to back ratio for frequencies within a low band from 698 MHz to 960 MHz and for frequencies within a high band from 1710 MHz to 2700 MHz. More specifically, the VSWR for port1 was 1.1487 at 698 MHz, 1.6547 at 960 MHz, 1.3517 at 1710 MHz, and 1.6924 at 2700 MHz. The VSWR for port2 was 1.1846 at 698 MHz, 1.5385 at 960 MHz, 1.6558 at 1710 MHz, and 1.3966 at 2700 MHz. The isolation between port1 and port2 was −36.612 dB at 698 MHz, −39,832 dB at 960 MHz, −28.034 dB at 1710 MHz, and −28.615 dB at 2700 MHz. The bandwidth spread was 57° to 71° for the low band and 48° to 78° for the high band. The gain (+/−0.5 decibels (dB)) was 8.2 dB to 9.7 dB for the low band from 698 MHz to 960 MHz and 6.1 dB to 9.8 dB for the high band from 1710 MHz to 2700 MHz. The front to back ratio was greater than 16.9 dB for the low band, and only the frequency 1880 MHz had a front to back ratio less than 15 dB for the high band.

In exemplary embodiments, an antenna assembly may be housed in a relatively low profile ceiling-mountable or tabletop appropriate package. By way of example, an antenna assembly disclosed herein may include ceiling/wall mounting clips and/or other means (e.g., mechanical fasteners, adhesives, frame-style mounts, etc.) for mounting and suspending the antenna assembly from a ceiling or other suitable structure. By way of further example, an antenna assembly disclosed herein may be used in systems and/or networks such as those associated with wireless internet service provider (WISP) networks, broadband wireless access (BWA) systems, wireless local area networks (WLANs), cellular systems, etc. The antenna assemblies may receive and/or transmit signals from and/or to the systems and/or networks within the scope of the present disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values (e.g., frequency ranges, etc.) for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances. Whether or not modified by the term "about", the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly comprising:

a first radiating element module operable in at least a first frequency range, the first radiating element module including a plurality of dipole elements arranged in a dipole square;

a second radiating element module operable in at least a second frequency range different than the first frequency range, the second radiating element module including a plurality of Vivaldi elements arranged in a crossed Vivaldi arrangement; and a reflector between the first and second radiating element modules such that the first and second radiating element modules are on opposite exterior and interior sides of the reflector, whereby the reflector is operable for isolating the plurality of Vivaldi elements from the plurality of dipole elements;

wherein:

the plurality of dipole elements comprises a first dipole element, a second dipole element, a third dipole element located opposite and across from the first dipole element in the dipole square; and a fourth dipole located opposite and across from the second dipole element in the dipole square;

the first and third dipole elements are fed in phase and radiate with a first polarization;

the second and fourth dipole elements are fed in phase and radiate with a second polarization orthogonal to the first polarization;

the plurality of Vivaldi elements comprises a first Vivaldi element and a second Vivaldi element, the first and second Vivaldi elements having orthogonal polarizations relative to each other;

the plurality of dipole elements comprises four dipole elements positioned at right angles relative to one another and aligned in an alignment of +/−45 degrees; and the reflector includes four walls defining a shape corresponding to the shape of the dipole square defined by the four dipole elements, each of the four walls being disposed between a corresponding one of the four dipole elements and the crossed Vivaldi elements.

2. The antenna assembly of claim 1, wherein at least one of the plurality of Vivaldi elements includes one or more electrically nonconductive areas configured for improved cross polarization radiation.

3. The antenna assembly of claim 1, wherein the second Vivaldi element is arranged relative to the first Vivaldi element to form a cruciform, which is located within a perimeter defined by the dipole square.

4. The antenna assembly of claim 3, wherein each of the first and second Vivaldi elements include an electrically nonconductive area configured for improved cross polarization radiation.

5. The antenna assembly of claim 1, wherein the second radiating element module is within a perimeter defined by the dipole square.

6. The antenna assembly of claim 1, further comprising an outer reflector to which are coupled the four walls of the reflector, the four dipole elements, and the plurality of Vivaldi elements, and wherein each said Vivaldi element includes:

a slot for slidably receiving a portion of another Vivaldi element;

one or more grounding portions configured to be positioned through one or more openings in the outer reflector for electrical connection and grounding to a printed circuit board; and a probe configured to be positioned through an opening in the outer reflector and an opening in the printed circuit board for electrical connection to a feed network and a backside of the probe grounded to the printed circuit board.

7. The antenna assembly of claim 1, wherein:

the first radiating element module is operable for transmitting and receiving electromagnetic radiation or signals in the first frequency range including frequencies from 698 Megahertz (MHz) to 960 MHz with two linear orthogonal polarizations; and the second radiating element module is operable for transmitting and receiving electromagnetic radiation or signals in the second frequency range including frequencies from 1710 MHz to 2700 MHz with two linear orthogonal polarizations.

8. An antenna assembly comprising:

a plurality of dipole elements defining a perimeter and operable in at least a first frequency range;

first and second Vivaldi elements within the perimeter defined by the plurality of dipole elements and operable in at least a second frequency range different than the first frequency range, the first and second Vivaldi elements arranged relative to each other to form a cruciform; and a reflector between the plurality of dipole elements and the first and second Vivaldi elements such that the plurality of dipole elements are on an opposite side of the reflector than the first and second Vivaldi elements, whereby the reflector is operable for isolating the first and second Vivaldi elements from the plurality of dipole elements;

wherein:

the plurality of dipole elements comprises four dipole elements; and the reflector includes four walls defining a shape corresponding to the perimeter defined by the four dipole elements, each of the four walls being disposed between a corresponding one of the four dipole elements and the first and second Vivaldi elements.

9. The antenna assembly of claim 8, wherein the first and second Vivaldi elements include one or more electrically nonconductive areas for improved cross polarization radiation.

10. The antenna assembly of claim 8, wherein the plurality of dipole elements are arranged in a dipole square in which the dipole elements are aligned in an alignment of +/−45 degrees and positioned at right angles relative to one another.

11. The antenna assembly of claim 10, wherein:

the plurality of dipole elements comprises a first dipole element, a second dipole element, a third dipole element located opposite and across from the first dipole element in the dipole square; and a fourth dipole located opposite and across from the second dipole element in the dipole square;

the first and third dipole elements are fed in phase and radiate with a first polarization;

the second and fourth dipole elements are fed in phase and radiate with a second polarization orthogonal to the first polarization; and the first and second Vivaldi elements have orthogonal polarizations relative each other.

12. The antenna assembly of claim 1, further comprising an outer reflector to which are coupled the four walls of the reflector, the plurality of dipole elements, and the first and second Vivaldi elements, wherein each of the first and second Vivaldi elements includes:

one or more grounding portions configured to be positioned through one or more openings in the outer reflector for electrical connection and grounding to a printed circuit board; and a probe configured to be positioned through an opening in the outer reflector and an opening in the printed circuit board for electrical connection to a feed network and a backside of the probe grounded to the printed circuit board.

13. The antenna assembly of claim 8, wherein:

the plurality of dipole elements is operable for transmitting and receiving electromagnetic radiation or signals in the first frequency range including frequencies from 698 Megahertz (MHz) to 960 MHz with two linear orthogonal polarizations; and the first and second Vivaldi elements are operable for transmitting and receiving electromagnetic radiation or signals in the second frequency range including frequencies from 1710 MHz to 2700 MHz with two linear orthogonal polarizations.

* * * * *